US011137166B1

(12) United States Patent
Yasinskiy

(10) Patent No.: US 11,137,166 B1
(45) Date of Patent: Oct. 5, 2021

(54) SYSTEM FOR INTERFACING A FLOOR VENT TO FLOORING

(71) Applicant: Vitaliy Viktorovich Yasinskiy, Vancouver, WA (US)

(72) Inventor: Vitaliy Viktorovich Yasinskiy, Vancouver, WA (US)

( * ) Notice: Subject to any disclaimer, the term of this patent is extended or adjusted under 35 U.S.C. 154(b) by 0 days.

(21) Appl. No.: 16/864,712

(22) Filed: May 1, 2020

(51) Int. Cl.

| | |
|---|---|
| ***F24F 13/06*** | (2006.01) |
| ***F24F 13/08*** | (2006.01) |
| ***E04F 15/18*** | (2006.01) |
| ***E04B 5/48*** | (2006.01) |

(52) U.S. Cl.
CPC ..... *F24F 13/084* (2013.01); *E04B 5/48* (2013.01); *E04F 15/18* (2013.01)

(58) Field of Classification Search
CPC ..... F24F 13/082; F24F 13/08; F24F 2221/40; F24F 13/06
See application file for complete search history.

(56) References Cited

U.S. PATENT DOCUMENTS

| | | | | |
|---|---|---|---|---|
| 2,054,694 | A * | 9/1936 | Eldredge | E04C 2/34 52/793.11 |
| 2,587,633 | A | 3/1950 | Levin | |
| 3,589,265 | A | 6/1971 | Hedrick | |
| 3,786,738 | A | 1/1974 | Fahre | |
| 4,346,543 | A * | 8/1982 | Wilson | E04D 3/3602 52/404.2 |
| 4,770,089 | A | 9/1988 | Vinicombe | |
| 5,163,871 | A | 11/1992 | Huibregtse et al. | |
| 5,586,933 | A | 12/1996 | Sawyer et al. | |
| 7,819,730 | B2 | 10/2010 | Ascroft | |
| 7,980,038 | B2 * | 7/2011 | O'Neal | E04F 13/0864 52/551 |
| 9,777,475 | B1 | 10/2017 | Yasinskiy | |
| 10,641,518 | B2 * | 5/2020 | Kennedy | F24F 13/068 |
| 10,648,173 | B1 * | 5/2020 | Harkins | E04B 1/84 |
| 2003/0220070 | A1 | 11/2003 | Orendorff | |
| 2006/0270336 | A1 | 11/2006 | Ascroft | |
| 2016/0326752 | A1 * | 11/2016 | Foura | E04B 1/003 |
| 2020/0299980 | A1 * | 9/2020 | McAuley | E04G 15/061 |

* cited by examiner

*Primary Examiner* — Brian E Glessner
*Assistant Examiner* — Daniel J Kenny
(74) *Attorney, Agent, or Firm* — Birdwell & Janke, LLP

(57) ABSTRACT

A system for interfacing a floor vent to floating flooring. The flooring is for covering a floor and the floor vent is for covering a hole through the floor. The system includes an underlayment for placement on the floor, the underlayment having a first compressibility; a floor vent for placement over the hole through the floor; a flooring material for placement on the underlayment, the flooring material having a second compressibility that is substantially less than the first compressibility; and an interface structure for placement on the floor, adjacent to the underlayment, beneath portions of the floor vent, and beneath portions of the flooring material adjacent to the floor vent, the interface structure having a third compressibility that is substantially less than the first compressibility.

20 Claims, 4 Drawing Sheets

SYSTEM FOR INTERFACING A FLOOR VENT TO FLOORING

FIELD OF INVENTION

The present invention relates to a system for interfacing a floor vent to flooring, which is particularly suited for use in circumstances where the flooring is used in conjunction with an underlayment.

BACKGROUND

Sub-floors (hereinafter "floors") are often covered with a decorative covering, which is typically referred to as "flooring" or "flooring material." The most common types of flooring materials are hardwood, engineered hardwood, laminate, carpet, tile, and "lineoleum" or polyvinylchloride (PVC). Cork is also sometimes used as a flooring material.

Flooring material may be adhered to the floor with an adhesive, but it is also common to simply lay the flooring material on the floor without adhering it to the floor, which allows the flooring material to "float" to accommodate thermal expansion and contraction.

Flooring material may also be laid on top of a relatively compliant padding or "underlayment," which is typically a layer of foam. Such an underlayment is typically provided where the flooring material is allowed to float.

Floor vents have "grill(e)s" or slatted grates defining a series of openings for passing air which, typically though not necessarily, has been either heated or cooled. The air is passed from a duct under a floor, through a hole in the floor, and through the openings in the floor vent into a room or other space in the building into which the air is intended to be supplied.

As described in U.S. Pat. No. 9,777,475 to Yasinskiy, it is desirable to form floor vents from flooring materials. Among other things, this provides for a better cosmetic match between the floor vent and the flooring, and ensures that the floor vent has the same thickness as the flooring, obviating the need for chiseling or routing the floor.

SUMMARY

A system for interfacing a floor vent to floating flooring is disclosed herein. The flooring is for covering a floor and the floor vent is for covering a hole through the floor. The system includes an underlayment for placement on the floor, the underlayment having a first compressibility; a floor vent for placement over the hole through the floor; a flooring material for placement on the underlayment, the flooring material having a second compressibility that is substantially less than the first compressibility; and an interface structure for placement on the floor, adjacent to the underlayment, beneath portions of the floor vent, and beneath portions of the flooring material adjacent to the floor vent, the interface structure having a third compressibility that is substantially less than the first compressibility.

The floor vent may be allowed to float on the interface structure.

The flooring material may be allowed to float on the underlayment.

The second compressibility may be less than half the first compressibility, and the third compressibility may be less than half the second compressibility.

The flooring material and the floor vent have respective top surfaces, and the interface structure as placed on the floor has one or more thicknesses measured vertically which may be adapted to maintain the top surface of the floor vent at or below the elevation of the top surface of the flooring.

The flooring material may be at least one of hardwood, engineered hardwood, laminate, carpet, tile, PVC, and cork, and the interface structure may be formed of metal.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DESCRIPTION OF PREFERRED EMBODIMENTS

Figure 1:
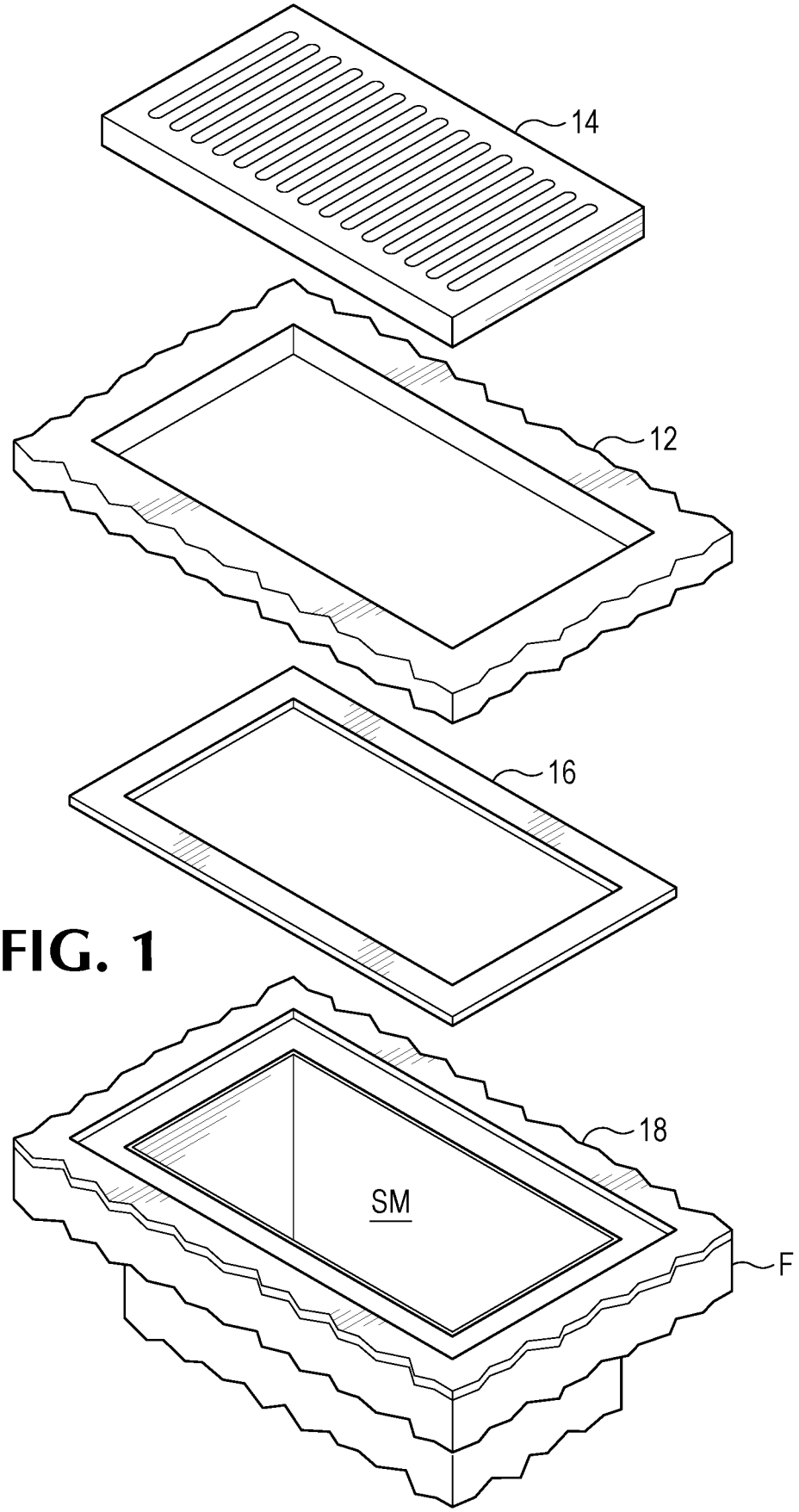
FIG. 1 is an isometric exploded view of a system for interfacing a floor vent to flooring according to the resent invention.
Figure 2:
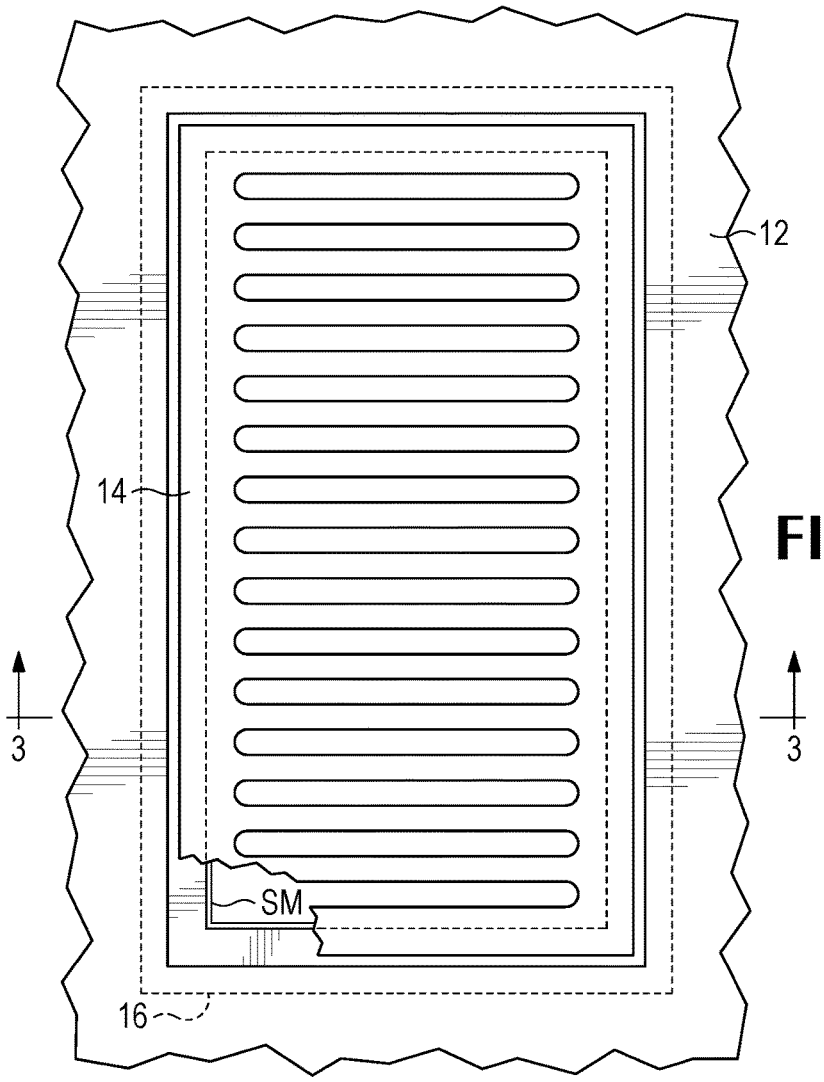
FIG. 2 is a plan view of the system of FIG. 1.
Figure 3:
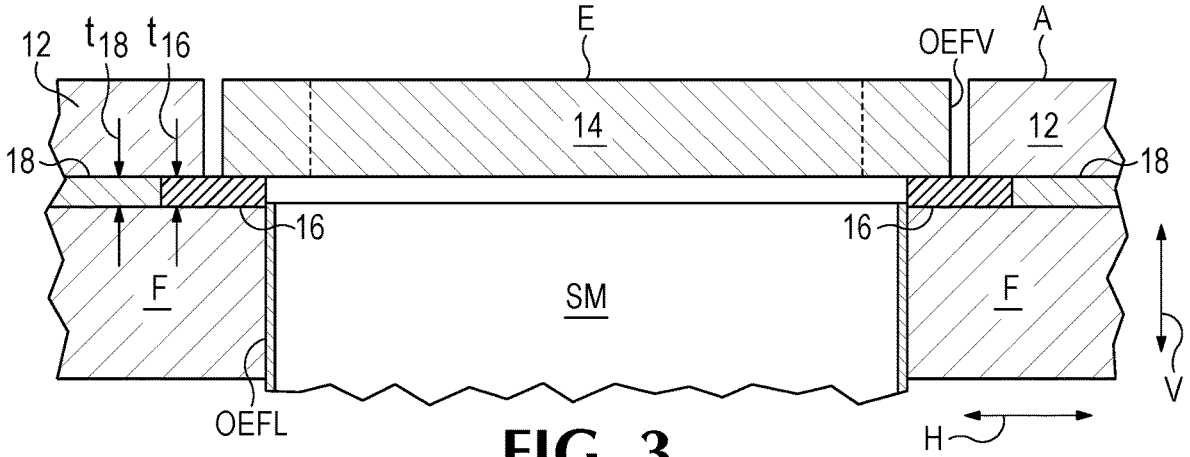
FIG. 3 is a side sectional view of the system of FIG. 1.

FIGS. 1-3 show a system. 10 for interfacing flooring 12 to a floor vent 14. As shown in FIG. 2, the system 10 includes an interface structure 16 for interfacing between the vent and the flooring. FIG. 3 shows the same elements in side section, installed on a floor "F," with the floor vent 10 disposed over a vent hole "VH" through the floor, typically lined with sheet metal "SM" that forms part of a duct, and with an underlayment 18 disposed between the flooring and the floor. It is an objective of the system 10 to address a problem caused by the underlayment.

The flooring 12 has a hole therethrough to provide space for the floor vent 14 to reside adjacent the flooring in a side-by-side relationship. In the vicinity of the outer edges "OEFV" of the floor vent 14, the interface structure 16 is disposed between the floor vent and the floor F; accordingly, the floor vent is vertically (directions parallel to the axis indicated as "V") supported by the interface, and the interface is vertically supported by the floor.

In the vicinity of the outer edges "OEFL" of the flooring 12, the interface structure 16 is disposed between the flooring and the floor F; accordingly, in this immediate vicinity, the flooring is vertically supported by the interface, and the interface is vertically supported by the floor, the same as for the floor vent 14.

But further away from the outer edges OEFL of the flooring 12, in horizontal directions (parallel to the axis indicated as "H") away from the interface structure 16, the flooring is vertically supported by the underlayment 18, and the underlayment is vertically supported by the floor F.

As is typical in the art, the flooring 12 is "relatively incompressible" compared to the underlayment 18; which is intended to function as a cushion for the flooring.

According to the present invention, the interface structure 16 is also relatively incompressible compared to the underlayment 18. Thus when a weight is applied to the flooring 12, such as at the location "A" indicated in FIG. 3, the underlayment 18 will compress more than the interface structure 16, and the portion(s) of the flooring that are supported by the interface structure 16 adjacent the floor vent 14 will not be vertically depressed, relative to the elevation "E" of the floor vent 14, as much as they otherwise would.

Thus the interface structure 16 reduces a tripping hazard when a person walks on the flooring 12, resulting from the elevation of the flooring 12, reduced by compression of the underlying materials in response to the load, being lower than the elevation of the floor vent 14, which has no such load applied.

The less compressible the interface structure 16 relative to the underlayment 18, the more the tripping hazard will be reduced. Preferably, the interface structure 16 is less than half as compressible as the underlayment, and more preferably it is less than 10% as compressible.

For example, the interface structure 16 may be formed of metal, or from another material such a hard or fiber-reinforced plastic that is relatively incompressible compared to the, typically foam, underlayment 18.

As shown and as will be typical, the underlayment 18 and all portions of the interface structure 16 that lie on the floor F and not over the hole 8 will be of uniform thickness. Those thicknesses, measured vertically along the axis V, as these structures are installed as shown in FIG. 3, are referenced as "$t_{16}$" for the interface structure 16, and "$t_{18}$" for the underlayment 18. These thicknesses are defined for uncompressed, un-weighted or "no-load" conditions, which is important at least for the underlayment, which will compress significantly under nom al loading.

Preferably the thickness $t_{16}$ of the interface structure 16 is equal to or less than the thickness $t_{18}$ of the underlayment 18 to ensure that the elevation of the floor vent 14 is kept below the elevation of the flooring 12, to eliminate the tripping hazard.

In FIG. 3, the thicknesses, again measured along the vertical axis V, of the flooring 12 and the floor vent 16 are the same, in accord with the teachings of the '475 Patent.

Figure 4:
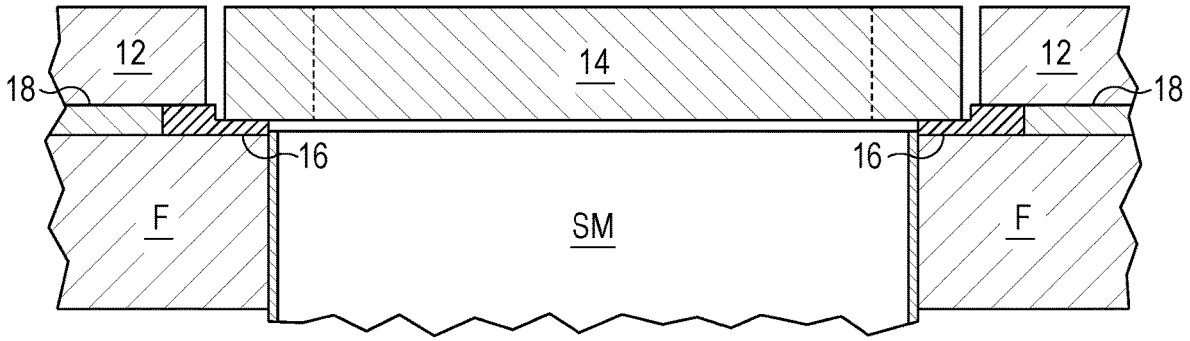
FIG. 4 is a side sectional view of a first alternative system according to the present invention, corresponding to the view of FIG. 3.
Figure 5:
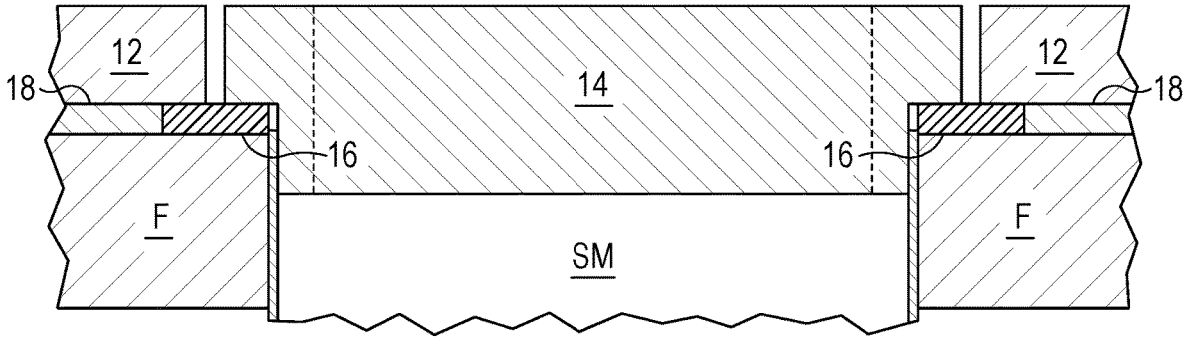
FIG. 5 is a side sectional view of a second alternative system according to the present invention, corresponding to the views of FIGS. 3 and 4.
Figure 6:
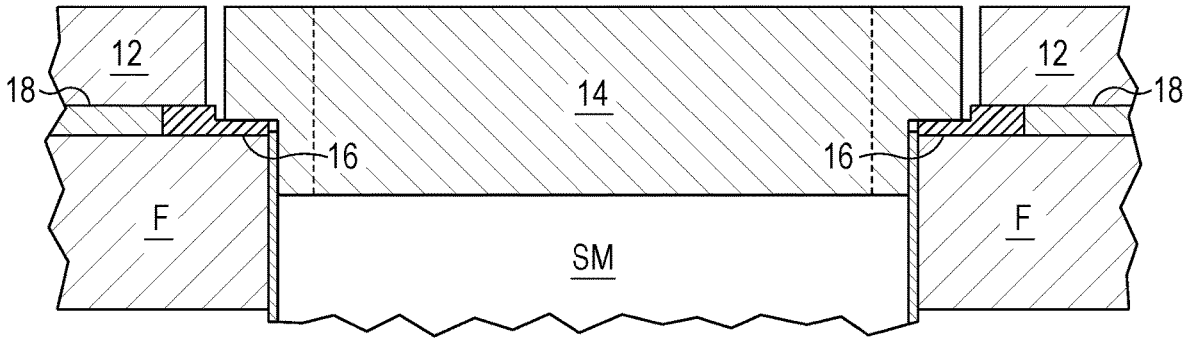
FIG. 6 is a side sectional view of a third alternative system according to the present invention, corresponding to the views of FIGS. 3-5.
Figure 7:
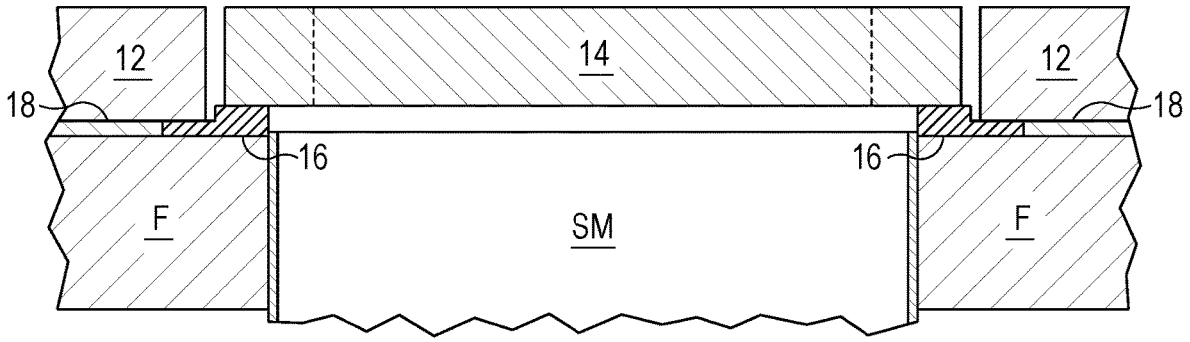
FIG. 7 is a side sectional view of a fourth alternative system according to the present invention, corresponding to the views of FIGS. 3-6.

FIGS. 4-6 show alternatives where the thickness of the floor vent is greater than the thickness of the flooring (the floor vent is referenced as "FV" and the flooring is referenced as "FL;" the underlayment is also shown, referenced as "UL"). For completeness, FIG. 7 shows an alternative where the thickness of the floor vent is less than the thickness of the flooring. These Figures show how the interface structure (referenced as "IS") can be modified, or not, to suit these alternative conditions.

In all cases, the interface structure has one or more thicknesses selected to keep the top surface of the floor vent, "$TS_{FV}$" either at the same elevation as, or at a lesser elevation than, the top surface of the flooring "$TS_{FL}$," when the flooring is unloaded.

Figure 8:
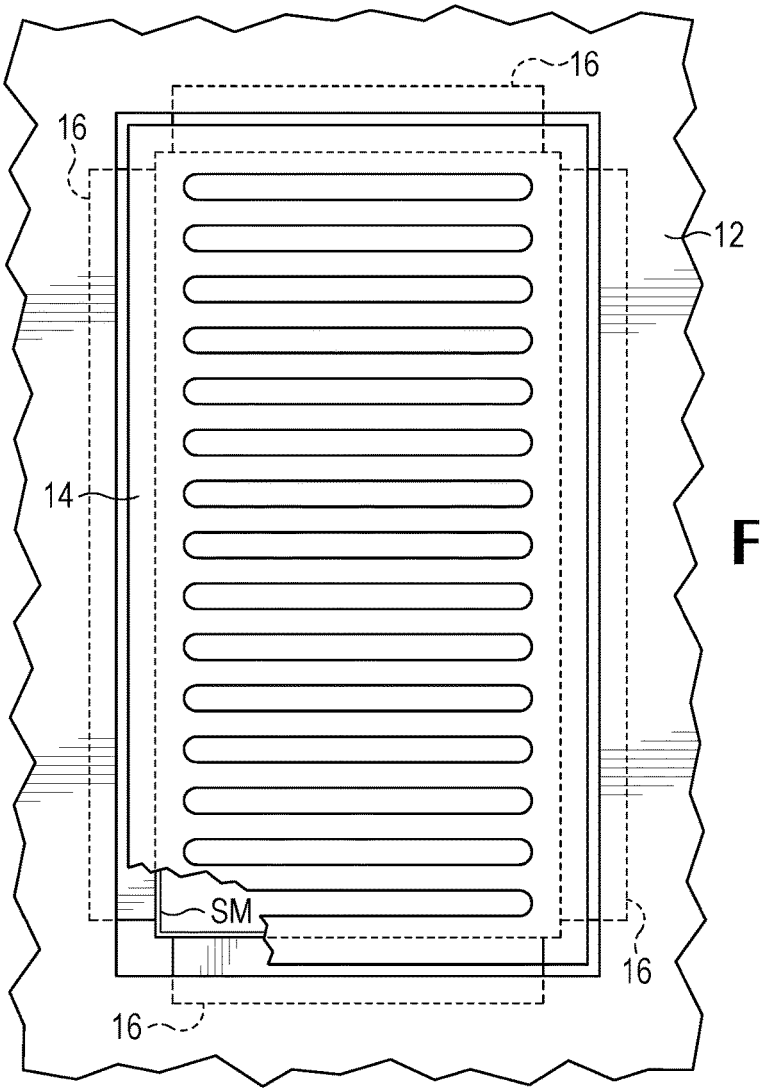
FIG. 8 is a plan view of a modification to the system of FIGS. 1-3 according to the present invention.

Returning to FIG. 2, the interface structure 16 is provided in the preferred embodiment as a single piece of such relatively incompressible material, extending a full 360 degrees around the floor vent 14. But it may also be provided in discontinuous portions or sections, such as shown in FIG. 8, that do not fully surround the floor vent. Preferably, the floor vent is surrounded by the interface over an angular range that, in total, exceeds 270 degrees.

Returning again to FIG. 2, the floor vent 14 is preferably allowed to "float" on the interface structure 16; i.e., the floor vent is preferably not attached or mounted to the interface, but this is not essential. As in the prior art, the flooring 12 is typically allowed to float on the underlayment 18; i.e., the flooring is typically not attached or mounted to the underlayment, but this is also not essential.

The interface structure 16 may also be allowed to float relative to either or both the floor and the flooring, but can alternatively be attached or mounted to either or both the top 6a surface of the floor, and/or the undersurface 12*a* of the flooring 12, such as by use of an adhesive, which may any suitable adhesive but which is preferably the same type of adhesive commonly used to adhere flooring to floors.

It is to be understood that, while a specific system for interfacing a floor vent to floating flooring has been shown and described as being preferred, variations may be made, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A system for interfacing a floor vent to flooring material, the flooring material for covering a floor and the floor vent for covering a hole through the floor, the system comprising:

an underlayment for placement on the floor, the underlayment having a first compressibility;

a floor vent for placement over the hole through the floor;

a flooring material for placement on the underlayment, the flooring material having a second compressibility that is substantially less than the first compressibility; and an interface structure for placement on the floor, adjacent to the underlayment, beneath portions of the floor vent so as to support the floor vent in such a manner that there is no need for the flooring material to provide any contributing support to the floor vent, and beneath portions of the flooring material adjacent to the floor vent so as to support said portions of the flooring material adjacent to the floor vent, the interface structure having a third compressibility that is substantially less than the first compressibility.

2. The system of claim 1, wherein the flooring material is at least one of hardwood, engineered hardwood, laminate, carpet, tile, PVC, and cork, and wherein the interface structure is formed of metal.

3. The system of claim 1, wherein the floor vent is allowed to float on the interface structure.

4. The system of claim 3, wherein the flooring material is at least one of hardwood, engineered hardwood, laminate, carpet, tile, PVC, and cork, and wherein the interface structure is formed of metal.

5. The system of claim 3, wherein the flooring material is allowed to float on the underlayment.

6. The system of claim 5, wherein the flooring material is at least one of hardwood, engineered hardwood, laminate, carpet, tile, PVC, and cork, and wherein the interface structure is formed of metal.

7. The system of claim 1, wherein the second compressibility is less than half the first compressibility, and the third compressibility is less than half the second compressibility.

8. The system of claim 7, wherein the flooring material is at least one of hardwood, engineered hardwood, laminate, carpet, tile, PVC, and cork, and wherein the interface structure is formed of metal.

9. The system of claim 7, wherein the floor vent is allowed to float on the interface structure.

10. The system of claim 9, wherein the flooring material is at least one of hardwood, engineered hardwood, laminate, carpet, tile, PVC, and cork, and wherein the interface structure is formed of metal.

11. The system of claim 9, wherein the flooring material is allowed to float on the underlayment.

12. The system of claim 11, wherein the flooring material is at least one of hardwood, engineered hardwood, laminate, carpet, tile, PVC, and cork, and wherein the interface structure is formed of metal.

13. The system of claim 1, wherein the flooring material and the floor vent have respective top surfaces, and wherein the interface structure as placed on the floor has one or more thicknesses measured vertically, adapted to maintain the top surface of the floor vent at or below the elevation of the top surface of the flooring.

14. The system of claim 13, wherein the floor vent is allowed to float on the interface structure.

15. The system of claim 14, wherein the flooring material is allowed to float on the underlayment.

16. The system of claim 13, wherein the second compressibility is less than half the first compressibility, and the third compressibility is less than half the second compressibility.

17. The system of claim 16, wherein the floor vent is allowed to float on the interface structure.

18. The system of claim 17, wherein the flooring material is allowed to float relative to the underlayment.

19. The system of claim 16, wherein the flooring material is at least one of hardwood, engineered hardwood, laminate, carpet, tile, PVC, and cork, and wherein the interface structure is formed of metal.

20. The system of claim 13, wherein the flooring material is at least one of hardwood, engineered hardwood, laminate, carpet, tile, PVC, and cork, and wherein the interface structure is formed of metal.

* * * * *